United States Patent [19]

Meckl et al.

[11] Patent Number: 5,021,326

[45] Date of Patent: Jun. 4, 1991

[54] PROCESS FOR RAPIDLY PROCESSING A COLOR PHOTOGRAPHY MATERIAL

[75] Inventors: Heinz Meckl, Bergisch Gladbach; Karl-Heinz Reuter, Frechen; Rudolf Tromnau, Cologne, all of Fed. Rep. of Germany

[73] Assignee: Agfa Gevaert Aktiengesellschaft, Leverkusen, Fed. Rep. of Germany

[21] Appl. No.: 504,549

[22] Filed: Apr. 4, 1990

[30] Foreign Application Priority Data

Apr. 18, 1989 [DE] Fed. Rep. of Germany ..... 3912639

[51] Int. Cl.[5] ..... G03C 7/30; G03C 7/26

[52] U.S. Cl. ..... 430/399; 430/434; 430/464; 430/467; 430/963; 430/567

[58] Field of Search ..... 430/399, 401, 434, 464, 430/467, 963, 567

[56] References Cited

U.S. PATENT DOCUMENTS

| | | | |
|---|---|---|---|
| 4,839,263 | 6/1989 | Miyoshi et al. | 430/963 |
| 4,861,702 | 8/1989 | Suzuki et al. | 430/963 |
| 4,897,340 | 1/1990 | Ohtani et al. | 430/963 |
| 4,925,778 | 5/1990 | Wernicke | 430/383 |
| 4,965,175 | 10/1990 | Fujimoto et al. | 430/963 |

FOREIGN PATENT DOCUMENTS

| | | | |
|---|---|---|---|
| 335107 | 10/1989 | European Pat. Off. | 430/963 |
| 4534 | 7/1987 | PCT Int'l Appl. | 430/963 |

OTHER PUBLICATIONS

James, T. H., *The Theory of the Photographic Process*, 1977, pp. 417–419.

Kodak, "Processing Techniques, Chemicals and Formulas", 1969, pp. 6 and 7.

*Primary Examiner*—Charles L. Bowers, Jr.
*Assistant Examiner*—Patrick A. Doody
*Attorney, Agent, or Firm*—Connolly & Hutz

[57] ABSTRACT

A process for processing a color photography silver halide recording material by development, bleach-fixing and stabilization or washing, wherein the silver halide emulsion layers of the photographic material have a chloride content of at least 80 mol %, the total processing time is not more than 60 seconds, the concentration of halide in the developing bath in the use state does not exceed $10^{-2}$ mol/l, the chloride content of the halide in the developing bath being at least 80 mol %, and the processing baths are replenished during continuous operation, provides results of good quality such as are otherwise obtained only by processing over a total period of at least 180 seconds.

6 Claims, No Drawings

PROCESS FOR RAPIDLY PROCESSING A COLOR PHOTOGRAPHY MATERIAL

The invention relates to a process for development, bleach-fixing and stabilization or washing of photographic materials containing silver chloride emulsions within a total time of not more than 60seconds, in which continuous operation is possible by replenishment of the baths. It relates in particular to processing of photographic materials with reflecting carriers.

For a large proportion of photosensitive silver halide recording materials there are standardized processing processes in which photographic recording materials of any desired origin can be processed true to type, for example for the production of coloured reflection images from colour negative paper using a transparent colour negative, the colour negative paper containing at least one blue-sensitive silver halide emulsion layer containing a yellow coupler, at least one green-sensitive silver halide emulsion layer containing a magenta coupler and at least one red-sensitive silver halide emulsion layer containing a cyan coupler.

In the processing which is carried out throughout the world for colour negative paper, called the EP-2 process or Agfacolor Process AP 92, the colour negative which has been exposed imagewise is subjected to colour development, bleaching, fixing, washing and drying, it being possible for the bleaching and fixing to be replaced by bleach-fixing and the washing by stabilization.

The colour development takes 210 seconds. Considerable efforts have been made to shorten this time. Only the Agfacolor Process AP 95, which allows a development time of 45 seconds using the usual colour negative paper, which essentially contains silver bromide emulsions with only low chloride contents (<20 mol% Cl) has so far found acceptance in industry.

A process which has a development time of 45 seconds and requires a colour negative paper which contains predominantly silver chloride emulsions >95 mol% Cl) and has a different developer composition has for some time been used industrially increasingly more (RA-4 process). This process utilizes the known fact that chloride emulsions can be developed faster than bromide emulsions. This is accompanied by a bleach-fixing bath time of 45 seconds and a stabilizing bath time of 90 seconds in four cascade stages.

The invention is based on the object of providing a processing process of not more than 60 seconds total duration, which can be carried out continuously by replenishment of the processing baths.

The invention relates to a process for continuous processing of a colour photography silver halide recording material by development, bleach-fixing and stabilization or washing and replenishing of the processing solutions, the total processing time being not more than 60 seconds, characterized in that the silver halide emulsion layers of the photographic material have a chloride content of at least 80 mol% and the concentration of halide in the developing bath in the use state does not exceed $10^{-2}$ mol/l, the chloride content of the halide of the developing bath being at least 80 mol%.

The silver halide emulsion layers of the photographic material used preferably contain more than 95 mol% chloride. The chloride content of the halide of the developing bath in the use state is likewise preferably more than 95 mol%.

A total processing time of not more than 60 seconds preferably requires division of the process into bath times of 8 to 12 seconds development, 8 to 12 seconds bleach-fixing and 3×5 to 12 seconds stabilization. The short developing time is possible only with a bath of extremely low halide content. A replenisher which keeps the halide emerging from the material during development so low that the sensitometric result initially obtained is also maintained during continuous operation is needed for this.

The temperature in the developing, bleach-fixing and stabilizing bath is preferably in the range from 35 to 40° C.

It has been found that on development of 1 $m^2$ of a silver halide material on average exposed imagewise with 99.5 mol% chloride, $9\times10^{-4}$ mol/l chloride passes into the developer solution if the developing time is 10 seconds. On the other hand, $2.95\times10^{-3}$ mol/l passes over during the standard developing time of 45 seconds.

If a halide-free bath is replenIshed with a replenisher which is likewise halide-free, the chloride emerging over a developing time of 10 seconds concentrates in the solution to varying degrees, depending on the replenishment rate. For example, the state of equilibrium is reached at the usual rate of 160 ml/$m^2$ with $5.7\times10^{-3}$ mol/l chloride. On the other hand, in the customary standard process of 45 seconds developing time and 160 ml/$m^2$ replenishment rate, the equilibrium concentration is $1.9\times10^{-2}$ mol/l chloride, taking into account only the amount of chloride emerging from the material. At the very low replenishment rate of 100 ml/$m^2$, the concentration in the case of 10 seconds developing time is $9\times10^{-3}$ mol/1, and in contrast $3\times10^{-2}$ mol/. at 45 seconds.

These low chloride concentrations of less than $10^{-2}$ mol/l influence the sensitometric results so little that they are practically not dIfferent to those of the chloride-free initial state. A constant replenishment is thus possible.

The reason for this low chloride loading lies in that fact that after 10 seconds the swelling of the layer has proceeded only to the extent of about 65%. The flow directed towards the inside of the layer considerably inhibits the exchange of matter directed outwards. In the subsequent bleach-fixing bath, the swelling is stopped and kept at this level, which means that the exchange of matter, which is substantial, is not impeded. The swelling which starts again during stabilization reaches a lower end value than usual, so that less water has to be removed during drying.

It was surprising that only a small portion of the amount of chloride to be expected from the standard process passes into the solution, that is to say that the exchange of matter between the layer package and solution is unilaterally impeded.

On the other hand, it was unexpected that the bleach-fixing operation, which is based on unimpeded exchange of matter in both directions, is not inhibited. In fact, the bleach-fixing stops the swelling.

The developer replenisher preferably contains no halide.

The filling of the developer tank is preferably halide-free. The concentration of chloride during replenishment should not exceed $10^{-2}$ mol/l.

p-Phenylenediamines, and in particular N,N-dialkyl-p-phenylenediamines, in which the alkyl groups and the aromatic nucleus are substituted or unsubstituted are particularly suitable primary aromatic amino developer substances. Examples of such compounds are 4-(N-ethyl-N-2-methanesulphonylaminoethyl)-2-methylphenylenediamine sesquisulphate monohydrate and 4-(N-ethyl-N-2-hydroxyethyl)-2-methylphenylenediamine sulphate.

When this process is used in continuous operation, it may moreover be advantageous to add to the developer solution wetting agents and complexing agents which accelerate the penetration of the solutions into the emulsion layers or bond calcium ions from the gelatin and the water.

Examples of suitable complexing agents for complexing calcium ions are aminopolycarboxylic acids which are well known per se. Typical examples of such aminopolycarboxylic acids are nitrilotriacetic acid, ethylenediaminetetraacetic acid (EDTA), 1,3-diamino-2-hydroxypropyltetraacetic acid, diethylenetriaminepentaacetic acid, N,N'-bis-(2-hydroxybenzyl)-ethylenediamine-N,N'-diacetic acid, hydroxyethylethylenediaminetriacetic acid, cyclohexanediaminotetraacetic acid and aminomalonic acid.

Other calcium-complexing agents are polyphosphates, phosphonic acids, aminopolyphosphonic acids and hydrolysed polymaleic anhydride, e.g. sodium hexametaphosphate, 1-hydroxyethane-1,1-diphosphonic acid, aminotrismethylenephosphonic acid and ethylenediaminetetramethylenephosphonic acid 1-Hydroxyethane-1,1-diphosphonic acid also acts as an iron-complexing agent.

It is furthermore advantageous to add iron-complexing agents to the developer solution.

Specific iron-complexing agents are e.g. 4,5-dihydroxy-1,3-benzenedisulphonic acid, 5,6-dihydroxy-1,2,4-benzenetrisulphonic acid and 3,4,5-trihydroxybenzoic acid.

About 0.2 to about 1.8 mol of a calcium-complexing agent per mol developer substance are preferably employed for complexing the calcium.

The iron-complexing agent is used in amounts of about 0.02 to about 0.2 mol per mol developer substance.

It may furthermore be advantageous to add to the solution whiteners, white couplers and antioxidant substances. Suitable antioxidizing agents are e.g. hydroxylamine and diethylhydroxylamine, as well as sulphites, which are preferably employed in an amount of up to 5 g/l.

Other possible constituents are optical brighteners, lubricants, e.g. polyalkylene glycols, surfactants, stabilizers, e.g. heterocyclic mercapto compounds or nitrobenzimidazole, and agents for establishing the desired pH. The developer solution can contain benzyl alcohol or be free from benzyl alcohol.

The developer solution is, in particular, an aqueous alkaline solution which has a pH above 7, in particular of 9 to 13. Buffer substances which are known per se, such as alkali metal carbonates and alkali metal phosphates, are used to establish this pH.

After the colour development, the material is usually bleached and fixed. Bleaching and fixing can be carried out separately from one another or together. Bleaching agents which can be used are the customary compounds, e.g. $Fe^{3+}$salts and $Fe^{3+}$complex salts.

Suitable iron(III) ion complex salts are complexes of iron(III) ions and a chelating agent, such as an aminopolycarboxylic acid, an aminopolyphosphonic acid or a salt thereof, in particular an alkali metal salt or ammonium salt.

Typical examples of chelating agents are ethylenediaminetetraacetic acid; disodium ethylenediaminetetraacetate; diammonium ethylenediaminetetraacetate; tetra(trimethylammonium)ethylenediaminetetraacetate; tetrapotassium ethylenediaminetetraacetate; tetrasodium ethylenediaminetetraacetate; trisodium ethylenediaminetetraacetate; diethylenetriaminepentaacetic acid; pentasodium diethylenetriaminepentaacetate; ethylenedimaine-N-(β-hydroxyethyl)-N,N',N'-triacetic acid; trisodium ethylenediamine-N-(β-hydroxyethyl)-N,N'N'-triacetate; triammonium ethylenediamine-N-(β-hydroxy-ethyl)-N,N',N'-triacetate; propylenediaminetetraacetic acid; disodium propylenediaminetetraacetate; nitrilotriacetic acid; trisodium nitrilotriacetate; cyclohexanediaminetetraacetic acid; disodium cyclohexanediaminetetraacetate; nitrilotriacetic acid; trisodium nitrilotriacetate; cyclohexanediaminetetraacetic acid; disodium cyclohexanediaminetetraacetate; iminodiacetic acid; dihydroxyethylglycine; ethyl ether-diaminetetraacetic acid; glycol ether-diaminetetraacetic acid; ethylenediaminetetrapropionic acid; phenylenediaminetetraacetic acid; 1,3-diaminopropanol-N,N,N',N'-tetramethylenephosphonic acid; ethy lenediamine-N,N,N'N'-tetramethylene-phosphonic acid; 1,3-propylenediamine-N,N,N',N'-tetramethylenephosphonic acid etc.

The iron(III) ion complex salt can be used in the form of the complex salt or prepared in situ in the bleaching or bleach-fixing bath. Suitable cations are alkali metal cations and ammonium; the latter is preferred.

In a bleach-fixing bath, the customary fixing agents, i.e. water-soluble agents which dissolve silver halide, such as thiosulphate (e.g. sodium thiosulphate, ammonium thiosulphate, ammonium sodium thiosulphate, potassium thiosulphate etc.); thiocyanates (e.g. sodium thiocyanate; ammonium thiocyanate; potassium thiocyanate etc.); thioether compounds (e.g. ethylenebisthioglycollic acid, 3,6-dithia-1,8-octanediol etc.); and thioureas can be used by themselves or in a combination of two or more.

Specific bleach-fixing agents which contain a combination of a fixing agent and a large amount of a halide compound, such as potassium iodide, can likewise additionally be used.

The iron(III) ion complex salt is usually present in the bleach-fixing composition in an amount of 0.1 to 1 mol/l. The amount of fixing agent is in general 0.2 to 4 mol per litre of the bleach-fixing solution.

Bleach-fixing solutions can moreover contain preserving agents, such as sulphites (e.g. sodium sulphite, potassium sulphite, ammonium sulphite etc.), hydroxylamine, hydrazine, aldehyde-bisulphite adducts (e.g. acetaldehyde-sodium bisulphite adduct) etc. Various optical brighteners, foam suppressants, surface-active agents, organic solvents (e.g. methanol) and known bleach-fixing accelerating agents, e.g. polyamine compounds (U.S. Pat. No. 3 578 457), thioureas (U.S. Pat. No. 3 617 283), iodides (DE-PS 1 127 715), polyethylene oxides (DE-PS 966 410), nitrogen-containing heterocyclic compounds (DE-PS 1 290 812) and other thioureas, can moreover be used. The pH of the bleach-fixing solution during use is usually 4.0 to 9.0, particularly preferably 5.0 to 8.0.

The bleach-fixing bath or fixing bath is usually followed by washing, which is carried out as countercurrent washing or consists of several tanks with a suitable water supply.

Favourable results can be obtained by using a subsequent final bath which contains only little formaldehyde, if any.

However, the washing can be replaced completely by a stabilizing bath, which is usually passed in countercurrent. This stabilizing bath usually contains a fungicide and an iron masking agent. It can additionally contain sulphites, sulphite-aldehyde adducts, wetting agents, metal salts, ammonium salts and glycols.

The following preferred embodiments apply to the individual processing baths:

| | |
|---|---|
| Developer | 10 ± 2 seconds<br>38 ± 0.5° C.<br>pH = 10.6 ± 0.1 tank<br>10.8 ± 0.1 replenisher<br>replenishment rate 100 ml/m$^2$ |
| Bleach-fixing bath | 10 ± 2 seconds<br>38 ± 1° C.<br>pH = 5.0 ± 0.2<br>replenishment rate 100 ml/m$^2$ |
| Stabilizing bath | 3 × 7 ± 2 seconds<br>38 ± 1° C.<br>pH = 5.0 ± 0.2<br>replenishment rate 250 ml/m$^2$. |

EXAMPLE 1

A colour photography recording material which is suitable for the process according to the invention was prepared by applying the following layers in the sequence shown to a layer carrier on paper coated with polyethylene on both sides. The amounts stated are in each case based on 1 m$^2$. The corresponding amounts of $AgNO_3$ are stated for the silver halide application.

Layer build-up 1:

1st layer (substrate layer):

0.2 g gelatin

2nd layer (blue-sensitive layer):

blue-sensitive silver halide emulsion (99.5 mol % chloride, 0.5 mol % bromide, average particle diameter 0.8 μm) from 0.63 g $AgNO_3$ with
1.38 g gelatin
0.95 g yellow coupler Y -continued Layer build-up 1:

0.2 g white coupler W
0.29 g tricresyl phosphate (TCP)

3rd layer (protective layer)

1.1 g gelatin
0.06 g 2,5-dioctylhydroquinone
0.06 g dibutyl phthalate (DBP)

4th layer (green-sensitive layer)

green-sensitized silver halide emulsion (99.5 mol % chloride, 0.5 mol % bromide, average particle diameter 0.6 μm) from 0.45 g $AgNO_3$ with
1.08 g gelatin
0.41 g magenta coupler M
0.08 g 2,5-diocytlhydroquinone
0.34 g DBP
0.04 g TCP 5th layer (UV stabilizer layer)

1.15 g gelatin
0.6 g UV absorber of the formula

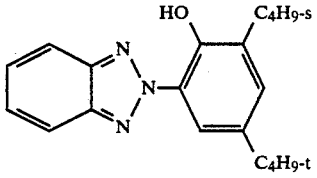

0.045 g 2,5-dioctylhydroquinone
0.04 g TCP

6th layer (red-sensitive layer)

red-sensitized silver halide emulsion (99.5 mol % chloride, 0.5 mol % bromide, average particle diameter 0.5 μm) from 0.3 g $AgNO_3$ with
0.75 g gelatin
0.36 g cyan coupler C
0.36 g TCP 7th layer (UV stabilizer layer)

0.35 g gelatin
0.15 g UV absorber according to 5th layer
0.2 g TCP

8th layer (protective layer)

0.9 g gelatin
0.3 g hardening agent H of the following formula

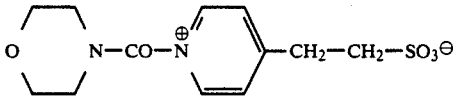

The components used have the following formula:

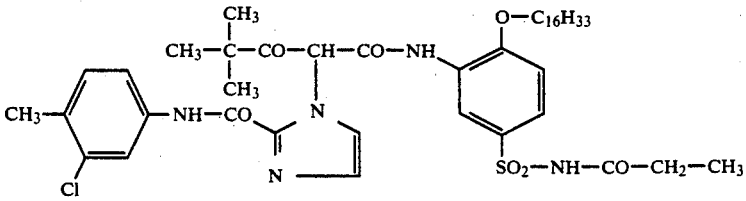

Y

-continued

M

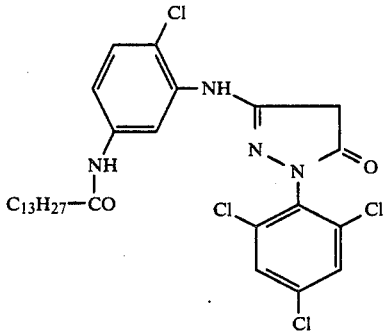

C

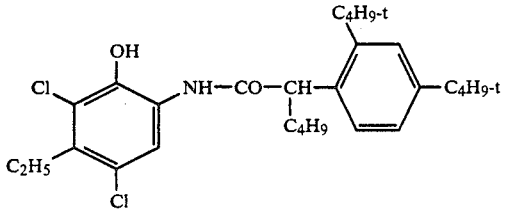

W

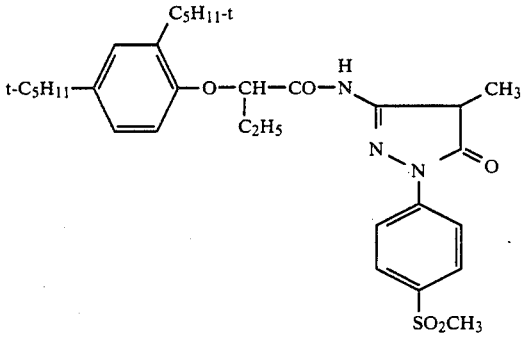

A step wedge is exposed on the photographic recording material described above and processed as follows:

| Process 1 (comparison) | |
|---|---|
| Developer 1 | 45 seconds 35° C. |
| Bleach-fixing bath 1 | 45 seconds 35° C. |
| Stabilizing bath 1 | 3 × 30 seconds 35° C. |

| Developer 1 1 liter contains: | Tank filling | Replenisher |
|---|---|---|
| diethylhydroxylamine | 5 g | 6.5 g |
| diethylene glycol | 20 ml | 30 ml |
| 4-(N-ethyl-N-2-methanesulphonyl-aminoethyl)-2-methylphenylenediamine sesquisulphate monohydrate (CD 3) | 5.7 g | 7.2 g |
| potassium sulphite | 0.2 g | 0.3 g |
| ethylenediaminetetraacetic acid (EDTA) | 2 g | 3 g |
| potassium carbonate | 28 g | 28 g |
| potassium chloride | 2.4 g | 1.2 g |
| adjust pH with potassium hydroxide | 10.1 | 10.5 |

| Bleach-fixing bath 1 1 liter contains: | Tank filling = Replenisher |
|---|---|
| ammonium thiosulphate | 140 g |
| ammonium sulphite | 20 g |
| mercaptotriazole | 1.5 g |
| ammonium iron EDTA | 114 g |
| EDTA | 15 g |
| pH (adjust with acetic acid) = 5.0 | |

| Stabilizing bath 1 1 liter contains: | Tank filling = Replenisher |
|---|---|
| hydroxyethanediphosphonic acid | 4 g |
| sodium sulphite | 2 g |
| 5-chloro-2-methylisothiazolid-3-one | 0.1 g |

-continued

| Process 1 (comparison) | |
|---|---|
| Developer 1 | 45 seconds 35° C. |
| Bleach-fixing bath 1 | 45 seconds 35° C. |
| Stabilizing bath 1 | 3 × 30 seconds 35° C. |

pH (adjust with sodium hydroxide) = 5.0

After exposure, the same material is processed by the process according to the invention:

| Process 2 | |
|---|---|
| Developer 2 | 10 seconds 38.5° C. |
| Bleach-fixing bath 2 | 10 seconds 38.5° C. |
| Stabilizing bath 2 | 3 × 7 seconds 38.5° C. |

| Developer 2 1 liter contains: | Tank filling | Replenisher |
|---|---|---|
| diethylhydroxylamine | 5 g | 6.5 g |
| diethylene glycol | 80 ml | 100 ml |
| CD 3 | 10.5 g | 17.5 g |
| potassium sulphite | 0.2 g | 0.3 g |
| ethylenediaminetetraacetic acid | 2 g | 2 g |
| potassium carbonate | 20 g | 20 g |
| adjust pH with potassium hydroxide: | 10.6 | 10.8 |

| Bleach-fixing bath 2 1 liter contains: | Tank filling = Replenisher |
|---|---|
| ammonium thiosulphate | 140 g |
| ammonium sulphite | 20 g |
| mercaptotriazole | 1.5 g |
| ammonium iron EDTA | 114 g |
| EDTA | 15 g |
| pH (adjust with acetic acid): | 5.0 |

| Stabilizing bath 2 | Tank filling = Replenisher |
|---|---|

-continued

| Process 2 | |
|---|---|
| Developer 2 | 10 seconds 38.5° C. |
| Bleach-fixing bath 2 | 10 seconds 38.5° C. |
| Stabilizing bath 2 | 3 × 7 seconds 38.5° C. |

| 1 liter contains: | |
|---|---|
| hydroxyethanediphosphonic acid | 10 g |
| 5-chloro-2-methylisothiazolid-3-one | 0.1 g |
| glycerol sulphite | 18 ml |
| adjust pH with sodium hydroxide: | 5.0 |

Comparison of the development results of procedure 2 according to the invention with the standard procedure shows an equally good quality by both processes.

EXAMPLE 2

If developer 3 is employed in the replenishment in process 2, the potassium chloride passing out of the material into the solution reaches an equilibrium value of 0.7 g/l if replenishment is performed with 100 ml/m$^2$.

| | Tank filling = Replenisher | |
|---|---|---|
| Developer 3 | | |
| 1 liter contains: | | |
| diethylhydroxylamine | 5 g | as developer 2 |
| diethylene glycol | 80 ml | |
| CD 3 | 10.5 g | |
| potassium sulphite | 0.2 g | |
| ethylenediaminetetraacetic acid | 2 g | |
| potassium carbonate | 20 g | |
| potassium chloride | 0.7 g | |
| adjust pH with potassium hydroxide: | 10.6 | |
| Bleach-fixing bath as bleach-fixing bath 2 | | |
| Stabilizing bath as stabilizing bath 2 | | |

If exposed material is developed in this manner and the sensitometric results are compared with those of process 2, no significant differences are found.

We claim:

1. In the continuous wet-processing of a color photographic silver halide recording material wherein a color photographic silver halide recording material having a chloride content of at least 80 mol % is subjected to wet-processing to a developed material in a total wet-processing time of not more than 60 seconds the steps comprising developing said recording material in a developing bath having a concentration of halide adapted to develop the material in the developing bath and not exceeding $10^{-2}$ mol/L and the chloride content of the developing bath halide being at least 80 mol % bleach-fixing, and stabilizing or washing, while replenishing said developing bath such that the halide concentration does not exceed $10^{-2}$ mol/L.

2. Wet processing as claimed in claim 1, characterized in that the silver halide emulsion layers of the photographic material used have a chloride content of more than 95 mol%.

3. Wet processing as claimed in claim 1, characterized in that the chloride content of the halide in the developing bath in the use state is greater than 95 mol%.

4. Wet-processing as claimed in claim 1, characterized in that the developer replenisher contains no halide, such that in the developing bath the halide concentration does not exceed $10^{-2}$ mol/L.

5. Wet-processing as claimed in claim 1, characterized in that the temperature in the developing, bleach-fixing and stabilizing bath is in the range from 35 to 40° C.

6. In the continuous wet-processing of a color photographic sivler halide recording material wherein a color photographic silver halide recording material having a chloride content of at least 80 mol % is subjected to processing to a developed material in a total processing time of not more than 60 seconds the steps comprising developing said recording material in a period of from 8 to 12 seconds in a developing bath having a concentration of halide adapted to develop the material in the developing bath and not exceeding $10^{-2}$ mol/L and the chloride content of the developing bath halide being at least 80 mol % bleach-fixing in a period of 8 to 12 seconds, and stabilizing or washing in a bath consisting of three tanks which are connected in countercurrent arrangement, and in that the residence time of the photographic material in each tank is in the range from 5 to 12 seconds.

* * * * *